US010010918B2

(12) United States Patent
Kitson et al.

(10) Patent No.: US 10,010,918 B2
(45) Date of Patent: Jul. 3, 2018

(54) DEVICE AND METHOD FOR LEVELING A METAL PLATE

(71) Applicant: Allor Manufacturing Inc., Brighton, MI (US)

(72) Inventors: James Kitson, Davisburg, MI (US); Anthony Allor, Fenton, MI (US); David Withrow, Chagrin Falls, OH (US)

(73) Assignee: Allor Manufacturing Inc., Brighton, MI (US)

( * ) Notice: Subject to any disclaimer, the term of this patent is extended or adjusted under 35 U.S.C. 154(b) by 0 days.

(21) Appl. No.: 15/286,310

(22) Filed: Oct. 5, 2016

(65) Prior Publication Data

US 2018/0093310 A1 Apr. 5, 2018

(51) Int. Cl.
*B21D 1/02* (2006.01)
*B21B 1/22* (2006.01)

(52) U.S. Cl.
CPC . *B21D 1/02* (2013.01); *B21B 1/22* (2013.01)

(58) Field of Classification Search
CPC ..... B21D 1/02; B21D 3/04
See application file for complete search history.

(56) References Cited

U.S. PATENT DOCUMENTS 3,374,654 A 3/1968 Uebing
3,699,726 A 10/1972 Turner et al.
3,839,888 A 10/1974 Greenberger
4,751,838 A 6/1988 Voges
5,279,141 A 1/1994 Kenmochi et al.
5,622,072 A 4/1997 Benz
5,709,759 A 1/1998 Ljungars et al.
6,732,561 B2 5/2004 Voges
7,013,693 B2 3/2006 Noe
7,081,169 B2 7/2006 Voges
8,707,529 B2 4/2014 Voges
2004/0089044 A1 5/2004 Tondo et al.
2005/0056067 A1* 3/2005 Clark ..... B21B 37/28 72/160
2007/0044531 A1 3/2007 Liefer et al.
2007/0163321 A1 7/2007 Brown
(Continued)

FOREIGN PATENT DOCUMENTS

EP 2933033 A1 10/2015
GB 2091603 A 8/1982

*Primary Examiner* — Debra Sullivan
(74) *Attorney, Agent, or Firm* — Quinn IP Law

(57) ABSTRACT

A method uses a device to level a metal plate fabricated from high-strength metal material. The method includes providing a serpentine path between a plurality of upper and lower rollers in parallel arrangement to define a longitudinal spacing. The upper and lower rollers are positioned relative to one another such that a plunge depth is defined based upon a difference between a top-dead-center point of the lower rollers and a bottom-dead-center point of contiguous upper rollers, and a longitudinal spacing and the plunge depth are configured such that the upper rollers and the lower rollers are disposed to impart a bend radius on the metal plate as the metal plate is drawn through the serpentine path such that the metal plate bends about the outer peripheral surfaces of the upper and lower rollers. The bend radius is selected to achieve a desired plastification of the metal sheet.

15 Claims, 4 Drawing Sheets

(56) References Cited

U.S. PATENT DOCUMENTS

| | | | |
|---|---|---|---|
| 2013/0327111 | A1 | 12/2013 | Abe |
| 2014/0157850 | A1 | 6/2014 | Buta |
| 2015/0251235 | A1 | 9/2015 | Smith et al. |

* cited by examiner

DEVICE AND METHOD FOR LEVELING A METAL PLATE

TECHNICAL FIELD

The present disclosure is related to a device and method of leveling a metal plate.

BACKGROUND

A metal plate may be subject to leveling to achieve a desired flatness that facilitates further processing of the metal plate. Metal plates fabricated from high-strength metals introduce added complexity to leveling due to increased elasticity and yield strengths.

SUMMARY

One possible aspect of the disclosure provides for a method to effect leveling of a sheet of high-strength metal material employing a leveler. The method includes providing a serpentine path in a longitudinal direction between a plurality of upper rollers and a corresponding plurality of lower rollers that are rotatably disposed in a parallel arrangement in a lateral direction. The longitudinal direction is associated with a direction of travel for the metal plate. There are equivalent quantities of the plurality of upper rollers and the plurality of lower rollers. Each of the upper rollers includes an upper roller radius and an outer peripheral surface that define a bottom-dead-center point. Likewise, each of the lower rollers includes a lower roller radius and an outer peripheral surface that define a top-dead-center point. The serpentine path and the upper and lower rollers are disposed to accommodate the metal plate. The method also includes positioning the upper rollers in alternating relation to the lower rollers in the longitudinal direction such that a longitudinal spacing is defined between contiguous ones of the upper rollers and the lower rollers, and positioning the upper rollers relative to the lower rollers in an elevation direction, such that a plunge depth is defined as a difference in the elevation direction between the top-dead-center point of each one of the lower rollers and the bottom-dead-center point of a contiguous one of the upper rollers. The longitudinal spacing between contiguous ones of the upper and lower rollers and the plunge depth are configured to impart a bend radius on the metal plate when the metal plate is drawn through the serpentine path, such that each surface of the metal plate bends about a portion of the outer peripheral surfaces of each of the plurality of upper rollers and the plurality of lower rollers. The metal plate is drawn through the serpentine path in the longitudinal direction such that the bend radius is imparted on the metal plate as each surface of the metal plate bends about the portion of the outer peripheral surfaces of the respective upper rollers and the lower rollers to achieve a magnitude of plastification of the metal sheet that is greater than 70%.

Another possible aspect of the disclosure includes a device that is configured to level a metal plate fabricated from high-strength steel material. The device includes a frame, a leveling station and a draw device. The leveling station includes a plurality of upper rollers and a corresponding plurality of lower rollers that are rotatably disposed on the frame in parallel arrangement in a lateral direction and define a serpentine path that is disposed in a longitudinal direction that is associated with a direction of travel for the metal plate. The draw device is disposed to draw the metal plate through the serpentine path along the direction of travel. Each of the upper rollers includes a cylindrical outer peripheral surface that extends in the lateral direction and radially surrounds an upper axis of rotation, and each of the lower rollers includes a cylindrical outer peripheral surface that extends in the lateral direction and radially surrounds a lower axis of rotation. The upper axes of rotation are offset in the longitudinal direction from the lower axes of rotation such that an equidistant longitudinal spacing is defined between the axes of rotation of contiguous ones of the upper and lower rollers. A plunge depth is defined based upon a difference between a top-dead-center point of one of the lower rollers and a bottom-dead-center point of a contiguous one of the upper rollers. The serpentine path is defined between the outer peripheral surfaces of contiguous ones of the plurality of upper rollers and the plurality of lower rollers.

The longitudinal spacing and the plunge depth are configured such that the upper rollers and the lower rollers are disposed to impart a bend radius on the metal plate as the metal plate is drawn, via the draw device, through the serpentine path as the metal plate bends about a portion of the outer peripheral surfaces of each of the upper rollers and the lower rollers to subject the metal plate to plastic deformation corresponding to the portion of the respective outer peripheral surfaces of each of the upper rollers and the lower rollers. Each bend radius is selected such that a magnitude of plastification of the metal sheet that is greater than 70% is achieved once the metal sheet exits the leveling station.

Another aspect of the disclosure provides for the longitudinal spacing and the plunge depth being configured such that the upper rollers and the lower rollers are disposed to impart a first bend radius on the metal plate in a first orientation and disposed to impart a second bend radius on the metal plate in a second orientation that is opposed to the first orientation, and the magnitude of the first bend radius is equivalent to the magnitude of the second bend radius.

The above features and advantages and other features and advantages of the present teachings are readily apparent from the following detailed description of the best modes for carrying out the present teachings when taken in connection with the accompanying drawings.

BRIEF DESCRIPTION OF THE DRAWINGS

FIG. 2 is a graphical illustration of a stress/strain relationship for metals, depicting modulus of elasticity, elastic deformation, yield strength and plastic deformation for select metal alloys, in accordance with the disclosure;

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, down, upper, lower, upward and downward may be used with respect to the drawings. These and similar directional terms are not to be construed to limit the scope of the disclosure in any manner. Furthermore, the disclosure, as illustrated and described herein, may be practiced in the absence of any element that is not specifically disclosed herein.

Figure 1:
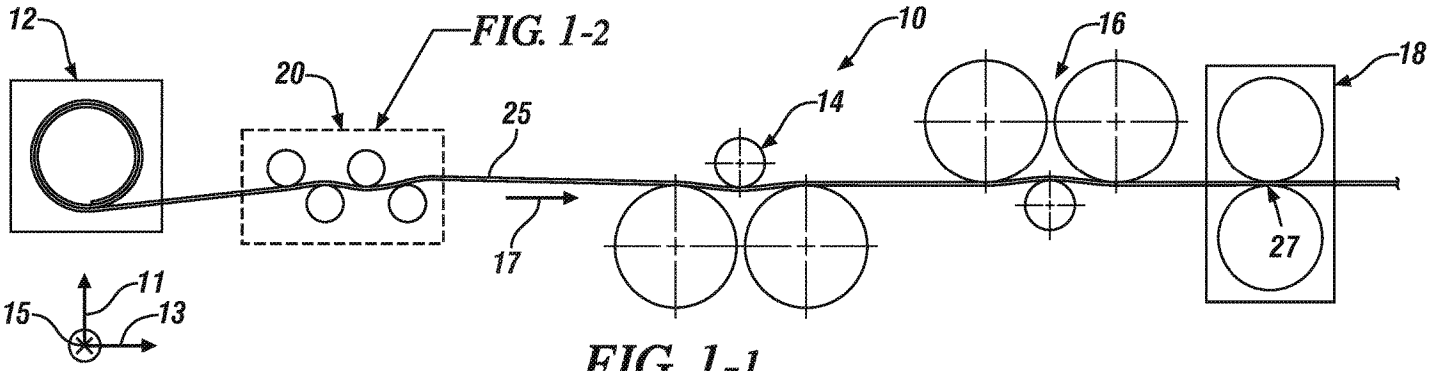
FIGS. 1-1 and 1-2 are schematic illustrations of a leveler that is capable of leveling a high-strength metal sheet, including a coil feeder device, a leveling station, an anti-crossbow station, an anti-coilset station and a draw device that are shown in context of an elevation direction, a lateral direction and a longitudinal direction, in accordance with the disclosure.
Figures 1, 2:
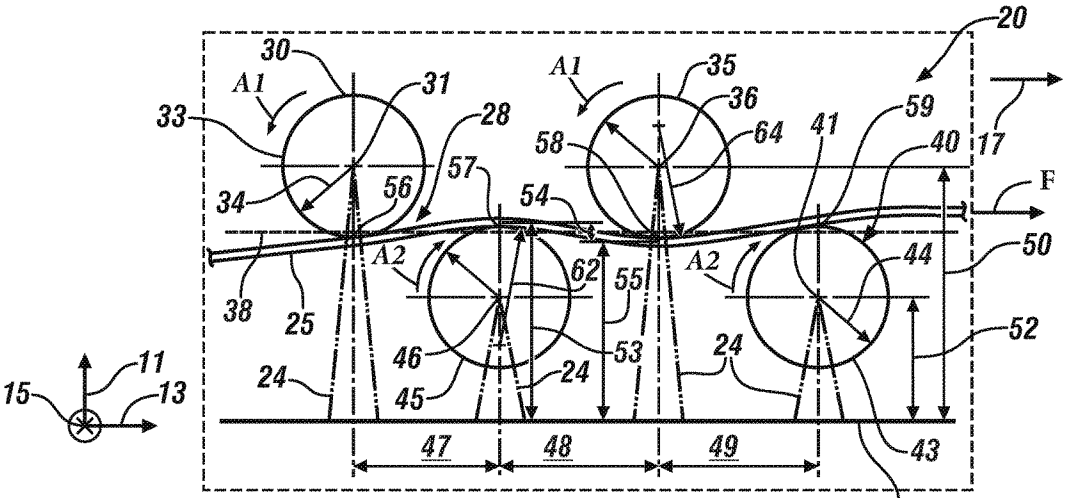
Figure 2:
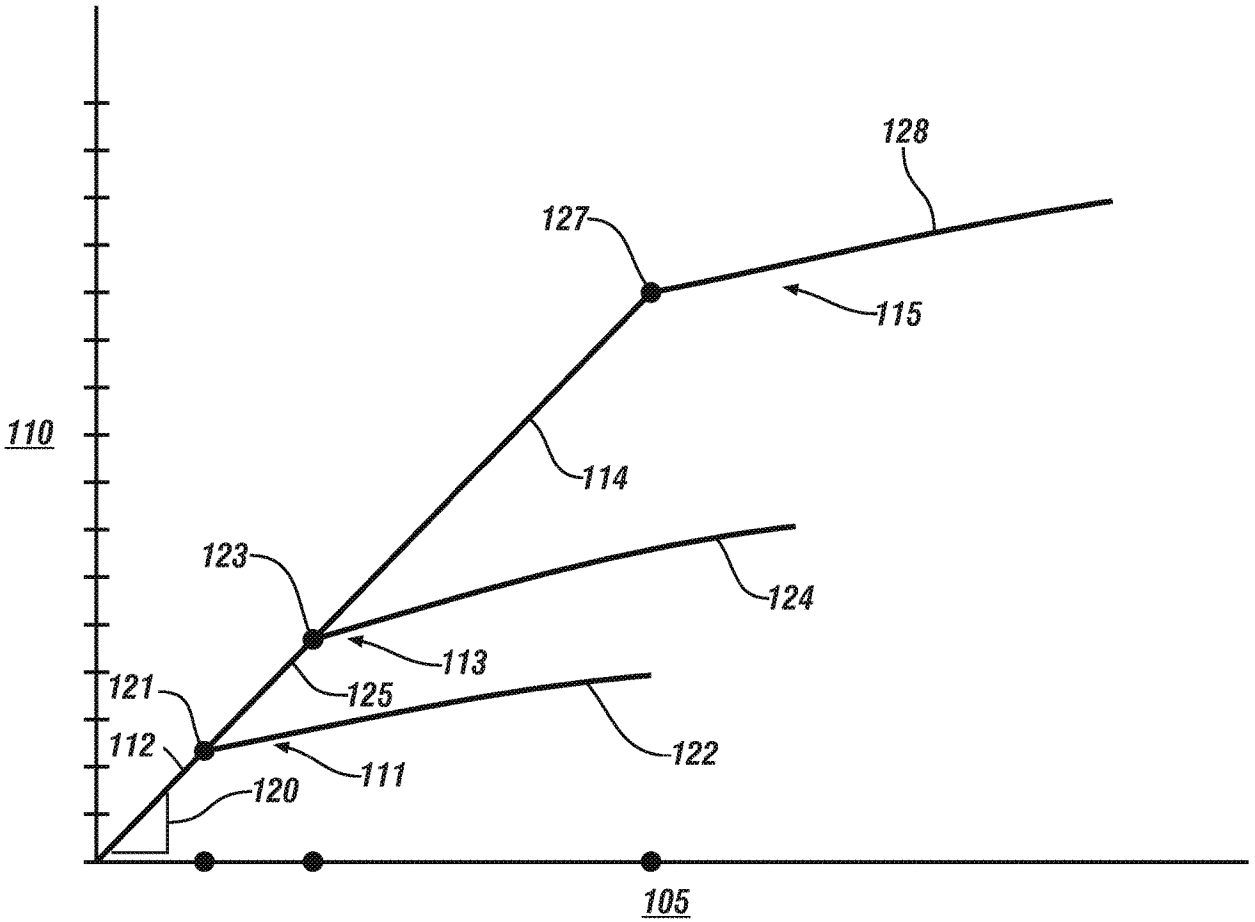

Referring to the drawings, wherein like reference numbers refer to like components throughout the several Figures, a side-view of a leveler 10 that is capable of leveling a metal sheet 25 that has been fabricated from high-strength materials is shown schematically in FIGS. 1-1 and 1-2. The metal sheet 25 may be in the form of a metal strip, coiled material, or a plate, and leveling is the process by which a leveling machine, i.e., the leveler 10 flattens the metal sheet 25 to comply with a flatness specification. The terms "plate" and "sheet" are used interchangeably throughout this disclosure. The leveler 10 preferably includes a coil feeder device 12, a leveling station 20, an anti-crossbow station 14, an anti-coilset station 16, and a draw device 18, all of which are shown in context of a coordinate system that includes an elevation direction 11, a longitudinal direction 13 and a lateral direction 15. A direction of travel 17 associated with movement of the metal sheet 25 through the leveler 10 is indicated in FIG. 1-1. The coil feeder device 12 may be any suitable device capable of uncoiling the metal sheet 25 when the metal sheet 25 is supplied in coiled form. The coil feeder device 12 may be freewheeling, such that the coil feeder device 12 is driven to uncoil the metal sheet 25 in response to a draw force F being exerted on a first end 27 of the metal sheet 25. The draw device 18 may be any suitable device that is capable of exerting a draw force F on a first end 27 of the metal sheet 25, to draw or pull the metal sheet 25 through the leveling station 20. The draw device 18 is shown as a unitary device for ease of illustration.

The anti-crossbow station 14 is any suitable device that is capable of correcting a transverse curvature across a width of the strip of the metal sheet 25, i.e., a transverse crossbow, which develops as a result of leveling. The anti-coilset station 16 may be any suitable device that is capable of correcting a coilset of the metal sheet 25.

The leveling station 20 of the leveler 10 is advantageously configured to level a metal plate. The metal plate may be fabricated from metal material, including, but not limited to steel. The steel may be a high-strength steel, high-strength low alloy steel (HSLA), and the like. However, the leveler 10 is not limited to leveling metal plate that is fabricated from a metal material that includes steel. Further, the leveler 10 is not limited to leveling metal plate that is high-strength. The metal plate, e.g., the metal sheet 25 described herein, may be leveled by the leveling station 20 of the leveler 20 by bending the metal sheet 25 up and down as the metal sheet 25 is drawn along a serpentine path 28 over interrupting arcs of upper and lower sets of rollers. The process of successively alternating the bends of the metal sheet 25 subjects both sides of the metal sheet 25 to bending stress beyond elastic limits to effect leveling via plastification. The leveling station 20 preferably includes a frame 24 disposed on a ground surface 22 to support a plurality of upper rollers 30, 35 and a plurality of lower rollers 40, 45. As shown, a quantity of two upper rollers 30, 35 and a corresponding quantity of two lower rollers 40, 45 are supported and employed. The equal quantity of two upper rollers 30, 35, and two lower rollers 40, 45 provide a balance in the plastification between both sides of the metal sheet 25. Alternatively, any quantity of the upper rollers 30, 35 and the lower rollers 40, 45 may be employed, so long as there is an equal quantity of each.

The upper rollers 30, 35 and the lower rollers 40, 45 are rotatably disposed on the frame 24 in parallel arrangement in the lateral direction 15 using suitable bearings, axles and related hardware. Preferably, the upper rollers 30, 35 and the lower rollers 40, 45 are rotatably disposed on the frame 24 in a freewheeling manner, such as with a freewheel device. As such, each upper roller 30, 35 and each lower roller 40, 45 is a freewheel device. The freewheel device may be a clutch or bearing that allows the respective upper roller 30, 35 and lower roller 40, 45 to turn freely about the respective axis of rotation 31, 36, 41, 46.

With reference to FIG. 1-2, the upper rollers 30, 35 and the lower rollers 40, 45 cooperate to define the serpentine path 28, which is oriented in the longitudinal direction 13. In response to the draw device 18 drawing the metal sheet 25 through the serpentine path 28 of the leveling station 20, one side of the metal sheet 25 is continuously bent about a portion of each of the corresponding upper rollers 30, 35 and the other side of the metal sheet 25 is bent about a portion of each of the corresponding lower rollers 40, 45. As the metal sheet 25 proceeds along the serpentine path 28, movement of the metal sheet 25 causes the upper rollers 30, 35 to rotate in unison in a first direction A1 and the lower rollers 40, 45 to rotate in unison in a second direction A2, opposite the first direction A1, as shown in FIG. 1-2. As the upper rollers 30, 35 and the lower rollers 40, 45 rotate in the respective directions A1, A2, the upper rollers 30, 35 and the lower rollers 40, 45 impart a bending stress on the corresponding portion of the metal sheet 25. Since the upper rollers 30, 35 and the lower rollers 40, 45 are offset in the longitudinal direction 13, and the serpentine path 25 weaves between the contiguous, alternating upper rollers 30, 35 and lower rollers 40, 45, the bending stresses imparted on one side of the metal sheet 25 by the upper rollers 30, 35 are balanced with the bending stresses imparted on the other side of the metal sheet 25 by the lower rollers 40, 45. The balance of the bending stresses imparted on the sides of the metal sheet 25 provide substantially equal plastification between the opposing sides of the metal sheet 25.

Notable, the bending stresses, and thus the plastification of the metal sheet 25, substantially results from the unidirectional draw force F, applied by the draw device 18, relative to the longitudinal direction 13, and is not the result of stress applied to the metal sheet 25 by a bi-directional force, relative to the longitudinal direction 13, as would be done in conventional tension leveling.

Each of the upper rollers 30, 35 extends in the lateral direction 15. As indicated, the upper roller 30 defines an axis of rotation 31, and a cylindrical outer peripheral surface 33 surrounding the axis of rotation 31 to define an upper roller radius 34. The upper roller 35 includes analogous elements, including an axis of rotation 36. The upper rollers 30, 35 are disposed such that their axes of rotation 31, 36 are both disposed at a first height 50 relative to the ground surface 22.

Each of the lower rollers 40, 45 also extends in the lateral direction 15 in parallel with the upper rollers 30, 35. As indicated, the lower roller 40 defines an axis of rotation 41, and a cylindrical outer peripheral surface 43 surrounding the axis of rotation 41 to define a lower roller radius 44. The lower roller 45 includes analogous elements, including an axis of rotation 46. The lower rollers 40, 45 are disposed such that their axes of rotation 41, 46 are both disposed at a second height 52 relative to the ground surface 22.

The upper rollers 30, 35 and the lower rollers 40, 45 are in alternating relation to one another, such that the axes of rotation 31, 36 of the upper rollers 30, 35, respectively are offset in the longitudinal direction 13 from the axes of rotation 41, 46 of the lower rollers 40, 45, respectively. The longitudinal spacings are defined between the axes of rotation of the contiguous ones of the upper and lower rollers. As shown, this includes a first longitudinal spacing 47 between the axis of rotation 31 and the axis of rotation 46, a second longitudinal spacing 48 between the axis of rotation 46 and the axis of rotation 36, and a third longitudinal spacing 49 between the axis of rotation 36 and the axis of rotation 41. Preferably, the first, second and third longitudinal spacings 47, 48 and 49 are substantially equal in length.

Referring again to FIG. 1-2, a leveling plane 38 is indicated, and is a nominally neutral plane associated with the serpentine path 28 that extends in the lateral and longitudinal directions 15, 13. A plunge depth 54 is shown in the elevation direction 11, and is related to a difference between top-dead-center points 59, 57 of the lower rollers 40, 45, respectively, and bottom-dead-center points 56, 58 of the upper rollers 30, 35, respectively. In one embodiment, the plunge depth 54 may be defined based upon a difference in the elevation direction 11 between a first elevation 53 that is associated with the top-dead-center points 59, 57 of the lower rollers 40, 45 and a second elevation 55 that is associated with the bottom-dead-center points 56, 58 of the upper rollers 30, 35. The plunge depth 54 may be determined based on a difference between the top-dead-center points of the lower rollers 40, 45 and the bottom-dead-center points of contiguous ones of the upper rollers 30, 35, upon the first and second elevations 53, 55 and the upper roller radius 34 and the lower roller radius 44. The serpentine path 28 is defined between the outer peripheral surfaces 33, 43 of contiguous ones of the upper rollers 30, 35 and the lower rollers 40, 45.

The leveling station 20 is configured such that the longitudinal spacings 47, 48 and 49, the plunge depth 54, the upper roller radius 34, and the lower roller radius 44 impart a desired bend radius on the metal plate 25 as the metal plate 25 is drawn through the serpentine path 28 such that the metal plate 25 bends about a portion of the outer peripheral surfaces 33, 43 of the upper rollers 30, 35 and the lower rollers 40, 45. The metal plate 25 is preferably subjected to plastic deformation when it bends about a portion of the outer peripheral surfaces 33, 43 of the upper rollers 30, 35 and the lower rollers 40, 45. This includes the longitudinal spacings 47, 48 and the plunge depth 54 being configured to impart a first bend radius 62 on the metal plate 25 in a first orientation, e.g., downward as shown. This also includes the longitudinal spacings 48, 49 and the plunge depth 54 being configured to impart a second bend radius 64 on the metal plate 25 in a second orientation that is opposed to the first orientation, e.g., upward as shown. Preferably, the magnitude of the first bend radius 62 is substantially equivalent to the magnitude of the second bend radius 64.

The leveling station 20 employs the upper rollers 30, 35 and the lower rollers 40, 45 to successively alternate the bending of the metal plate 25 as it is drawn through the serpentine path 28 to subject a first outer area of the metal plate 25, located on a first surface thereof, to a bending stress, and subject a second outer area of the metal plate 25, located on a second, opposite surface thereof, to a bending stress.

When a relatively smaller force, e.g., a force less than the yield strength of a material, is applied to the material, the material deforms elastically, with the deformation being linearly proportional to the applied force, such that the elastic deformation is reversible, e.g., the material does not permanently change shape. The relationship between elastic deformation and applied stresses defines the materials' modulus of elasticity, or Young's modulus. For steel, the modulus of elasticity is approximately one divided by 30 million psi (1/30E6 psi). For aluminum, the modulus of elasticity is about one divided by ten million psi (1/10E6 psi). If the metal is never stressed beyond its elastic range, the metal will never permanently change shape. However, stressing metal beyond its elastic range causes it to become plastic, i.e., to permanently deform. This occurs when the applied stress reaches or exceeds a yield strength of the material.

With reference to FIG. 1-2, the leveler 10 employs bending of the metal sheet 25, back and forth, about a portion of each of the upper rollers 30, 35 and the lower rollers 40, 45, to subject opposing sides of the metal sheet 25 to bending stresses that are greater than the yield strength of the metal sheet, such that plastification of at least a portion of the metal sheet 25 effects leveling of the metal sheet. The bending is achieved by drawing the metal sheet 25 through the serpentine path 28 to subject the metal sheet 25 to bending stresses that are greater than the yield strength of the metal sheet.

Referring now to FIG. 2, FIG. 2 graphically illustrates a stress/strain relationship for various metals, with the horizontal axis 105 indicating strain or elongation, and the vertical axis 110 indicating stress, or force on the metals. Results associated with three metals are shown, including a modulus of elasticity and a yield strength for a first metal 111, a second metal 113 and a third metal 115. The first metal 111, known in the industry as A36, as set forth American Society for Testing and Materials (ASTM), is a steel alloy characterized in terms of a modulus of elasticity 120 of about 1/30E6 psi, an elastic deformation portion 112, a yield strength 121 of about 36,000 psi, and a plastic deformation portion 122. The second metal 113, known in the industry as X70, is characterized in terms of a modulus of elasticity 120 of about 1/30E6 psi, an elastic deformation portion 125, a yield strength 123 of about 70,000 psi, and a plastic deformation portion 124. The third metal 115, known in the industry as AR500, is characterized in terms of a modulus of elasticity 120 of about 1/30E6 psi, an elastic deformation portion 114, a yield strength 127 of about 180,000 psi, and a plastic deformation portion 128. The third metal 115 has an elastic limit or yield strength that is five times greater than that of the first metal 111. The second metal 113 and the third metal 115 are high-strength steel materials, wherein the term "high-strength" is assigned based upon the associated yield strength.

A bend radius can be defined for a metal sheet, in relation to various factors, as follows:

$$Rs=E*T/k*Ys \quad [1]$$

wherein:

Rs is the bend radius (inches),

E is the modulus of elasticity (psi),

T is the thickness of the metal sheet (inches), k is a scalar term associated with the desired magnitude of plastification of the metal sheet, and Ys is the yield strength of the metal (psi).

The term "plastification" and related terms refer to plastically elongating an element, e.g., a metal sheet, including subjecting the metal sheet to stress that is in excess of its elastic limit, and may be defined in terms of a portion (%) of a cross-sectional area of the metal sheet. As such, a metal sheet that has only been subjected to stress that is less than its elastic limit has a 0% plastification, and a metal sheet that has been subjected, across its entire cross-sectional area, to stress that is greater than its elastic limit has a 100% plastification.

With continued reference to FIG. 2, the third metal 115 exhibits a yield strength 127 of about 180,000 psi, which is a factor of five greater than the yield strength 121 of the first metal 111. As such, the third metal 115 requires a bend radius that is five times smaller than the bend radius of the first metal 111 to achieve the same magnitude of plastification using the method and apparatus described herein.

As the yield strength of the material being leveled increases, in order to achieve the desired level of plastification, a larger plunge depth 54 is required in order to impart a larger bend radius. As such, as the yield strength of the material being leveled increases, the required draw force F increases at a linear rate in order to achieve the desired magnitude of plastification. As such, by way of a non-limiting example, the linear rate for the first metal 111, i.e., A36, is about a 5:1. However, as the thickness of the metal sheet 25 increases, in order to achieve the desired magnitude of plastification, a smaller plunge depth 54 is required. As such, thinner gauge steel requires a greater increase in plunge depth 54, as the yield strengths increase, as compared to thicker gauges. Likewise, this requires that a roller with a smaller roll diameter, as the yield strengths increase for thin gauge steel.

Figure 3:
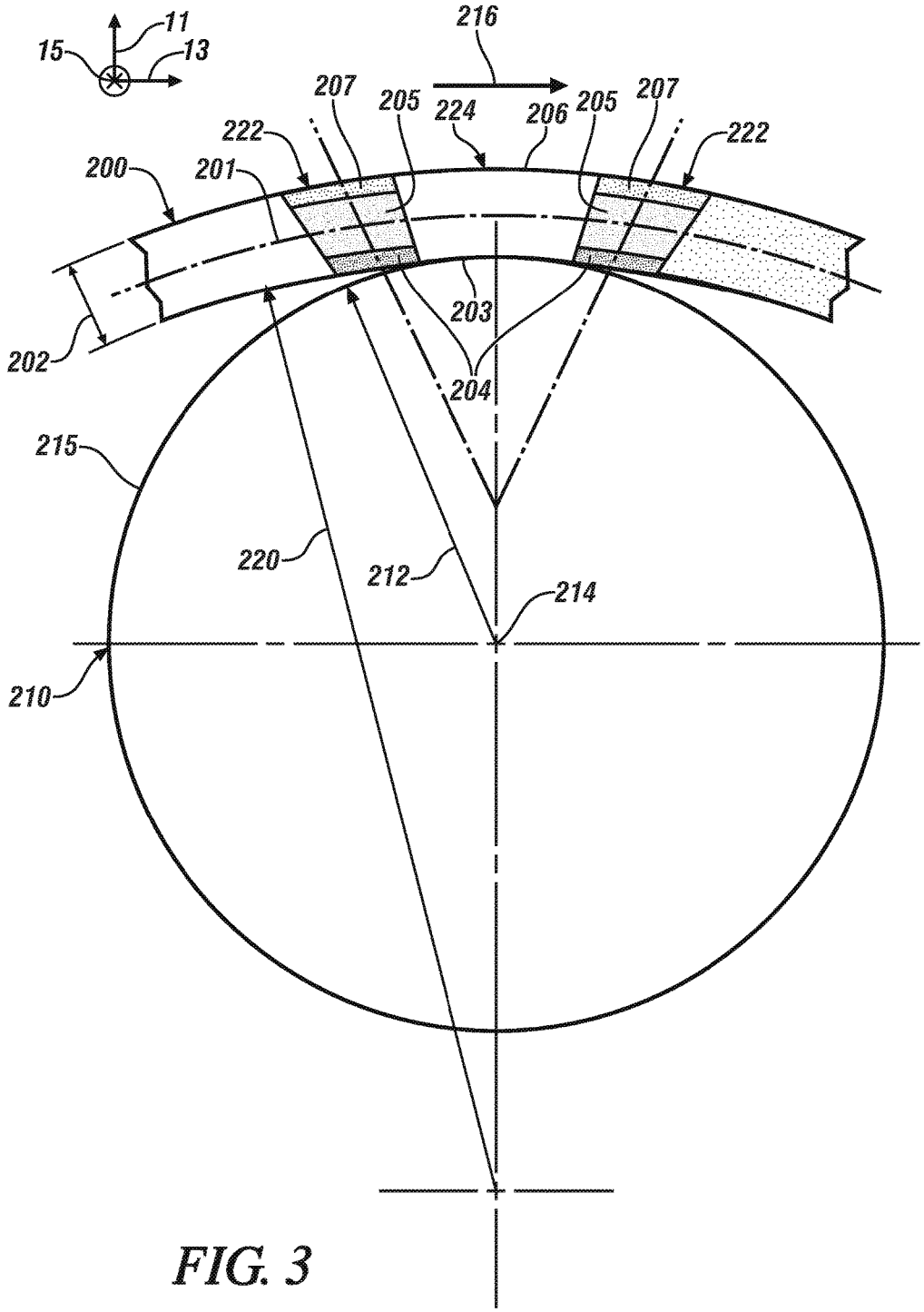
FIG. 3 schematically shows a side-view of a portion of a high-strength metal sheet that is being drawn across a roller in the longitudinal direction at a first bending radius such that the metal sheet bends about the roller, in accordance with the disclosure.

FIG. 3 schematically shows a side-view of a portion of a high-strength metal sheet 200 that is being drawn across a roller 210 in the longitudinal direction 13, such that the metal sheet 200 bends around a portion of the roller 210 at a first bending radius 220, with the metal sheet 200 and roller 210 projecting in the lateral direction 15. The metal sheet 200 is characterized in terms of a thickness 202, and is described in terms of a centerline 201, an inner surface 203 and an outer surface 206, wherein the inner surface 203 is that portion of the metal sheet 200 that is proximal to the roller 210 and the outer surface 206 is that portion of the metal sheet 200 that is distal from the roller 210. The roller 210 is analogous to one of the upper or lower rollers 30, 40 that is described with reference to FIGS. 1-1 and 1-2, and includes an axis of rotation 214 and a cylindrical outer peripheral surface 215 surrounding the axis of rotation 214 that define a roller radius 212. A direction of travel 216 is shown, and indicates the direction that the metal sheet 200 is being drawn.

With continuing reference to FIG. 3, the metal sheet 200 includes areas of stress deformation 222 and an area of bending 224 as the metal sheet 200 is drawn across a portion of the roller 210 and is subject to bending about a portion of the roller 210. The areas of stress deformation 222 include an inner portion 204 that is adjacent to the inner surface 203 and an outer portion 207 that is adjacent to the outer surface 206. The first bending radius 220 is determined in accordance with EQ. 1.

When the metal sheet 200 is subjected to forces that achieve the first bending radius 220, the areas of stress deformation 222 may be defined in terms of an inner portion 204, a neutral portion 205 and an outer portion 207. The outer portion 207 delineates that portion of the cross-sectional area of the metal sheet 200 that is subject to bending that is sufficient to be plastically stretched. The inner portion 204 delineates that portion of the cross-sectional area of the metal sheet 200 that is subject to bending that is sufficient to be plastically compressed. Likewise, as the metal sheet 200 proceeds through the serpentine path 28, the metal sheet 200 bends in the opposite direction, and that same portion of the cross-sectional area of the metal sheet 200 that was subject to be plastically compressed, becomes plastically stretched. The neutral portion 205 is only subjected to elastic bending. The inner portion 204 and the outer portion 207 each define the magnitude of plastification of the metal sheet 200, which may be any desired percentage, up to the order of magnitude of 50%, as shown. As such, any desired plastification across the entire metal sheet 200, in the order of magnitude of up to nearly 100%, may be achieved. It would be understood that, at plastification approaching 100%, the neutral portion 205 is negligible, e.g., is substantially non-existent.

Figure 4:
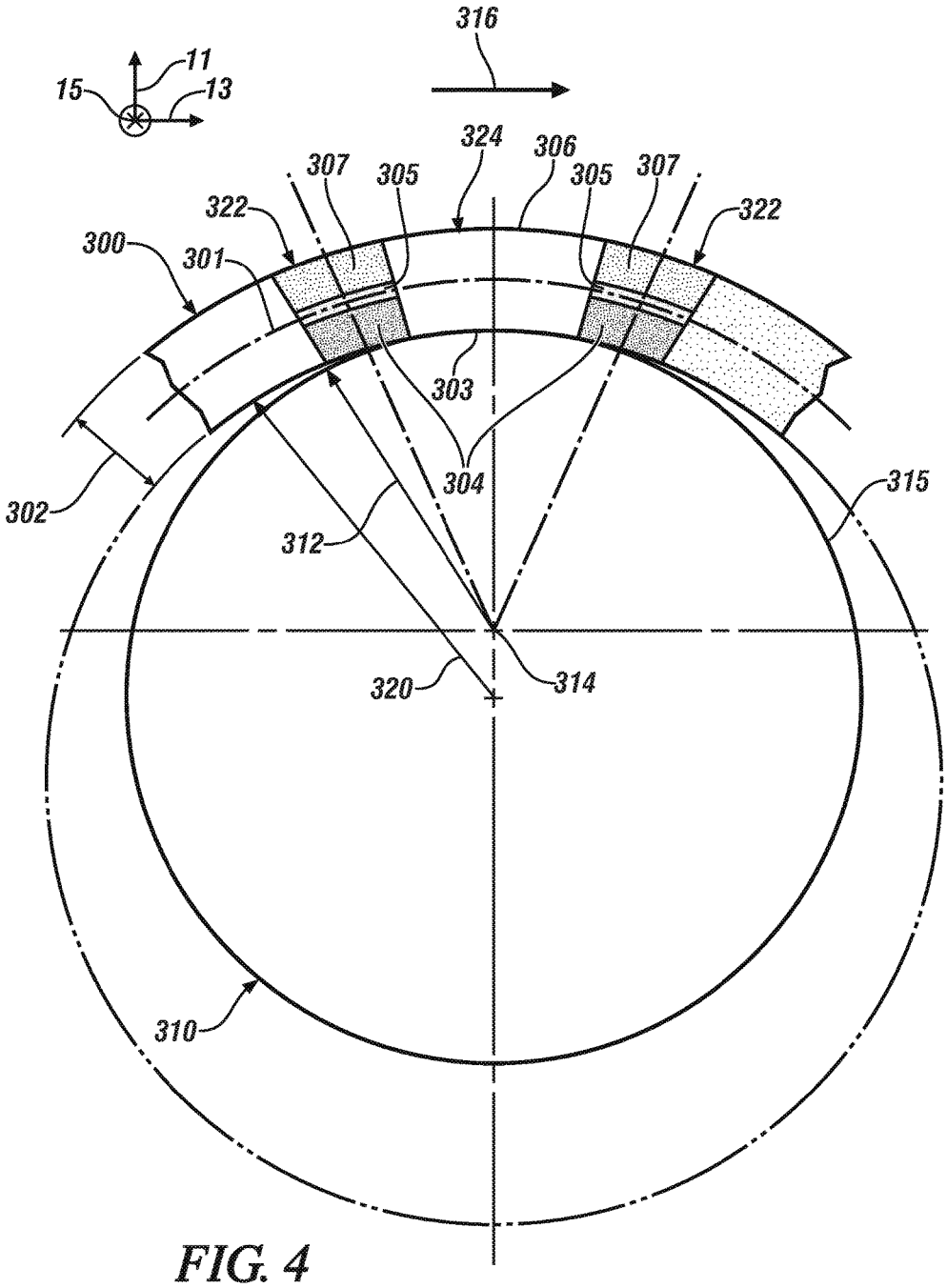
FIG. 4 schematically shows a side-view of a portion of a high-strength metal sheet that is being drawn across a roller in the longitudinal direction at a second bending radius such that the metal sheet bends about the roller, in accordance with the disclosure.

FIG. 4 schematically shows a side-view of a portion of a high-strength metal sheet 300 that is being drawn across a roller 310 in the longitudinal direction 13 at a second bending radius 320 such that the metal sheet 300 bends about a portion of the roller 310, with the metal sheet 300 and roller 310 extending in the lateral direction 15. The metal sheet 300 is characterized in terms of a thickness 302, and is described in terms of a centerline 301, an inner surface 303 and an outer surface 306, wherein the inner surface 303 is that portion of the metal sheet 300 that is proximal to the roller 310 and the outer surface 306 is that portion of the metal sheet 300 that is distal from the roller 310. The roller 310 is analogous to one of the upper or lower rollers 30, 40 that is described with reference to FIG. 1, and includes an axis of rotation 314 and a cylindrical outer peripheral surface 315 surrounding the axis of rotation 314 that define a roller radius 312. A direction of travel 316 is shown, and indicates the direction that the metal sheet 300 is being drawn.

The metal sheet 300 includes areas of stress deformation 322 and an area of bending 324 as the metal sheet 300 is drawn across the roller 310 and is subject to bending about a portion of the roller 310. The areas of stress deformation 322 include an inner portion 304 that is adjacent to the inner surface 303 and an outer portion 307 that is adjacent to the outer surface 306. The second bending radius 320 is determined in accordance with EQ. 1.

When the metal sheet 300 is subjected to forces that achieve the first bending radius 320, the areas of stress deformation 322 may be defined in terms of an inner portion 304, a neutral portion 305 and an outer portion 307. The outer portion 307 delineates that portion of the cross-sectional area of the metal sheet 300 that is subject to bending that is sufficient to be plastically elongated. The inner portion 304 delineates that portion of the cross-sectional area of the metal sheet 300 that is subject to bending that is sufficient to be plastically compressed, and also be plastically elongated when bent in an opposed direction. The neutral portion 305 is only subjected to elastic bending. The inner portion 304 and the outer portion 307 define the magnitude of plastification of the metal sheet 300, which may each be any desired percentage, up to the order of magnitude of 50% for the bending radius 320. As such, any desired plastification across the entire metal sheet 300, in the order of magnitude of up to 100%, may be achieved.

As such, bending is achieved by controlling the plunge depth 54 and the longitudinal spacings between the axes of rotation of the contiguous ones of the upper and lower rollers. Decreasing the bending radius from the first bending radius 220 shown with reference to FIG. 3 to the second bending radius 320 shown with reference to FIG. 4 results in an increase in the plastification of the associated metal sheet. Therefore, one or more of these parameters may be selectively varied to achieve any desired plastification of the metal sheet, including plastification of the metal sheet that is greater than 70%. Further, plastification of the metal sheet at relatively higher plastification levels, e.g., from 90% to 100% may be achieved by selectively varying one or more of these parameters. It would be understood that, at plastification approaching 100%, the neutral portion 205 is negligible, e.g., is substantially non-existent.

By way of a non-limiting example, one embodiment of the leveling station 20 may be configured with each of the upper rollers 30, 35 and the lower rollers 40, 45 having a radius of 0.75 inches and arranged at a longitudinal spacing of 3.375 inches with a plunge depth 54 of 1.25 inches to achieve a bend radius of less than 0.875 inches for a steel sheet that is 0.08 inches thick and 60 inches wide with a 100,000 psi yield strength. This arrangement can generate plastification of the steel sheet that is greater than 90%, while requiring the draw force F of approximately 70,000 pounds to be applied by the draw device 18. Overall, the bend radius is greater than or equal to the roller radius, where thinner gauge metal sheets require a higher bend radius, which leads to smaller roller radius. It should be appreciated that this concept applies to steel and other metal alloys of any magnitude of yield strength. Further, the combination of the plunge depth 54, the radius of the upper rollers 30, 35 and the lower rollers 40, 45, the longitudinal spacing, and the draw force F imparted by the draw device 18, allows greater than 90% plastification to be achieved using a leveling station 20 including only, i.e., not more than, two upper rollers 30, 35 and two lower rollers 40, 45. Further, the combination of the plunge depth 54, the radius of the upper rollers 30, 35 and the lower rollers 40, 45, the longitudinal spacing, and the draw force F imparted by the draw device 18 may be configured to allow the desired amount of plastification, without the addition of heat to the metal sheet.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A method for leveling a metal plate fabricated from high-strength metal material and having opposing surfaces, comprising:

providing a serpentine path in a longitudinal direction between one pair of upper rollers and a corresponding one pair of lower rollers that are rotatably disposed in a parallel arrangement in a lateral direction, such that the longitudinal direction is associated with a direction of travel for the metal plate;

wherein each of the one pair of upper rollers includes an upper roller radius and an outer peripheral surface that define a bottom-dead-center point and each of the one pair of lower rollers includes a lower roller radius and an outer peripheral surface that define a top-dead-center point, wherein the radii of each of the one pair of upper rollers and the radii of each one of the one pair of lower rollers are equivalent, and wherein the serpentine path and the upper and lower rollers are disposed to accommodate the metal plate;

positioning each of the one pair of upper rollers in alternating relation to each of the one pair of lower rollers in the longitudinal direction such that a longitudinal spacing is defined between contiguous ones of the one pair of upper rollers and the one pair of lower rollers;

positioning the one pair of upper rollers relative to the one pair of lower rollers in an elevation direction, such that a plunge depth is defined as a difference in the elevation direction between a first elevation associated with the top-dead-center point of each of the one pair of lower rollers and a second elevation that is associated with the bottom-dead-center point of each of the one pair of upper rollers;

wherein the magnitude of the plunge depth associated with the one pair of upper rollers and a one of the one pair of lower rollers that is longitudinally disposed between the one pair of upper rollers is equal to the magnitude of the plunge depth associated with the one pair of lower rollers and a one of the one pair of upper rollers that is longitudinally disposed between the one pair of lower rollers;

wherein the longitudinal spacing between contiguous ones of the one pair of upper rollers and the one pair of lower rollers is equal;

wherein the equal longitudinal spacing between contiguous ones of the one pair of upper and lower rollers and the equal magnitude of the plunge depths are configured to impart a first bend radius on the metal plate in a first orientation and a second bend radius on the metal plate in a second orientation that is opposite the first orientation when the metal plate is drawn through the serpentine path, such that each surface of the metal plate bends about a portion of the outer peripheral surfaces of each of the respective one of the one pair of upper rollers and the respective one of the one pair of lower rollers to provide equal plastification on both sides of the metal plate; and drawing the metal plate through the serpentine path in the longitudinal direction such that the one pair of upper rollers and the one of the one pair of lower rollers that is longitudinally disposed between the pair of upper rollers imparts the first bend radius on the metal plate and the one pair of lower rollers and the one of the one pair of upper rollers that is longitudinally disposed between the one pair of lower rollers subsequently imparts the second bend radius on the metal plate as each surface of the metal plate bends about the portion of the outer peripheral surfaces of the respective one of the one pair of upper rollers and the one of the one pair of lower rollers to achieve a magnitude of plastification of the metal plate that is greater than 70%;

wherein the magnitude of the first bend radius is equivalent to the magnitude of the second bend radius; and wherein there is a quantity of not more than the one pair of upper rollers and a quantity of not more than the one pair of lower rollers to achieve equal plastification on both sides of the metal plate.

2. The method of claim 1, wherein each surface of the metal plate bends about the portion of the outer peripheral surfaces of the respective one of the one pair of upper rollers and the respective one of the one pair of lower rollers to achieve a magnitude of plastification of the metal plate that is greater than 90%.

3. The method of claim 1, further comprising:

determining a required bend radius as a function of a modulus of elasticity of the metal material of the metal plate, a thickness of the metal plate, the magnitude of plastification of the metal plate, and a yield strength of the metal material of the metal plate; and selecting a plunge depth configured to achieve the required bend radius.

4. The method of claim 1, wherein the each of the one pair of upper rollers and the one pair of lower rollers is a freewheel device.

5. The method of claim 1, wherein drawing the metal plate through the serpentine path in the longitudinal direction further includes drawing the metal plate through the serpentine path in the longitudinal direction such that the one pair of upper rollers and the one of the one pair of lower rollers that is longitudinally disposed between the pair of upper rollers imparts a first bending stress on a first side of the metal plate and the one pair of lower rollers and the one of the one pair of upper rollers that is longitudinally disposed between the pair or lower rollers imparts a second bending stress on a second side of the metal plate, opposite the first side, such that the first and second bending stresses are equal to provide equal plastification on the first and second sides of the metal plate.

6. A device configured to level a metal plate fabricated from high-strength metal material, the device comprising:

a frame;

a leveling station including one pair of upper rollers and a corresponding one pair of lower rollers rotatably disposed on the frame in a parallel arrangement in a lateral direction and defining a serpentine path that is disposed in a longitudinal direction that is associated with a direction of travel for the metal plate; and a draw device disposed to draw the metal plate through the serpentine path along the direction of travel;

wherein each one of the one pair of upper rollers includes a cylindrical outer peripheral surface that extends in the lateral direction and radially surrounds an upper axis of rotation;

wherein each one of the one pair of lower rollers includes a cylindrical outer peripheral surface that extends in the lateral direction and radially surrounds a lower axis of rotation;

wherein the radii of each one of the one pair of upper rollers and the radii of each one of the one pair of lower rollers are equivalent;

wherein the upper axes of rotation are offset in the longitudinal direction from the lower axes of rotation such that a longitudinal spacing is defined between the axes of rotation of contiguous ones of the one pair of upper rollers and the one pair of lower rollers;

wherein a plunge depth is defined as a difference in an elevation direction between a first elevation associated with a top-dead-center point of each one of the one pair of lower rollers and a second elevation that is associated with a bottom-dead-center point of each one of the one pair of upper rollers;

wherein the magnitude of the plunge depth associated with each one of the one pair of upper rollers and a one of the one pair of lower rollers that is longitudinally disposed between the one pair of upper rollers is equal to the magnitude of the plunge depth associated with each one of the one pair of lower rollers and a one of the one pair of upper rollers that is longitudinally disposed between the one pair of lower rollers;

wherein the serpentine path is defined between the outer peripheral surfaces of contiguous ones of the one pair of upper rollers and the one pair of lower rollers;

wherein the longitudinal spacing of each one of the one pair of upper rollers and each one of the one pair of lower rollers is equal to achieve the equal plastification on the first and second sides of the metal plate;

wherein the longitudinal spacing and the plunge depth are configured such that the one pair of upper rollers and the one of the one pair of lower rollers that is longitudinally disposed between the one pair of upper rollers imparts a first bend radius on the metal plate in a first orientation and the one pair of lower rollers and the one of the pair of upper rollers that is longitudinally disposed between the one pair of lower rollers subsequently imparts a second bend radius on the metal plate in a second orientation that is opposed to the first orientation as the metal plate is drawn, via the draw device, through the serpentine path as the metal plate bends about a portion of the outer peripheral surfaces of each one of the one pair of upper rollers and each one of the one pair of lower rollers to subject the metal plate to plastic deformation corresponding to the portion of the respective outer peripheral surfaces of each one of the one pair of upper rollers and each one of the one pair of lower rollers to provide equal plastification on both sides of the metal plate;

wherein the magnitude of the first bend radius and the magnitude of the second bend radius is selected such that a magnitude of plastification of the metal plate that is greater than 70% is achieved once the metal plate exits the leveling station; and wherein the magnitude of the first bend radius is equivalent to the magnitude of the second bend radius; and wherein there is a quantity of not more than the one pair of upper rollers and a quantity of not more than the one pair of lower rollers to achieve equal plastification on both sides of the metal plate.

7. The device of claim 6, wherein each bend radius is selected such that a magnitude of plastification of the metal plate that is greater than 90% is achieved once the metal plate exits the leveling station.

8. The device of claim 6, wherein the bend radius is determined as a function of a modulus of elasticity of the material of the metal plate, a thickness of the metal plate, the magnitude of plastification of the metal plate, and a yield strength of the material of the metal plate.

9. The device of claim 8, wherein each bend radius is determined as a function of a yield strength of the metal material of the metal plate being greater than 50,000 psi.

10. The device of claim 6, wherein the draw device being disposed to draw the metal plate through the serpentine path from a first end of the metal plate, wherein a magnitude of draw force is determined as a function of the bend radius.

11. The device of claim 6, wherein the each of the one pair of upper rollers and the one pair of lower rollers is a freewheel device.

12. The device of claim 6, wherein the draw device is disposed to draw the metal plate through the serpentine path absent an addition of heat thereto.

13. The device of claim 6, wherein the longitudinal spacing, the upper rolling radii, lower rolling radii, and the plunge depth are configured such that as the metal plate is drawn through the serpentine path in the longitudinal direction, the pair of upper rollers impart a first bending stress on a first side of the metal plate and the pair of lower rollers impart a second bending stress on a second side of the metal plate, opposite the first side, such that the first and second bending stresses are equal to provide equal plastification on the first and second sides of the metal plate.

14. A device configured to level a metal plate fabricated from high-strength steel material, the device comprising:

a leveling station including a first and second upper roller and a first and second lower roller rotatably disposed on a frame in parallel arrangement in a lateral direction;

wherein each of the first and second upper rollers includes an upper roller radius and a cylindrical outer peripheral surface that extends in the lateral direction and radially surrounds an upper axis of rotation;

wherein each of the first and second lower rollers includes a lower roller radius and a cylindrical outer peripheral surface that extends in the lateral direction and radially surrounds a lower axis of rotation;

wherein the upper axes of rotation are offset in the longitudinal direction from the lower axes of rotation such that an equidistant longitudinal spacing is defined between the axes of rotation of contiguous ones of the first and second upper and lower rollers;

where the radii of each of the first and second upper rollers and the radii of each of the first and second lower rollers are equivalent;

wherein a first plunge depth associated with the first upper roller and the first and second lower rollers is defined based upon a difference in an elevation direction between a top-dead-center point of the first and second lower rollers and a bottom-dead-center point of a contiguous one of the upper rollers;

wherein a second plunge depth associated with the first and second upper rollers and the second lower roller is defined based upon a difference in the elevation direction between the top-dead-center point of the second lower roller and the bottom dead center point of the first and second upper rollers;

wherein the magnitude of the first plunge depth is equal to the magnitude of the second plunge depth;

wherein a serpentine path is defined between the outer peripheral surfaces of contiguous ones of the first and second upper rollers and the first and second lower rollers and is disposed in a longitudinal direction that is associated with a direction of travel for the metal plate;

wherein the longitudinal spacing, the upper and lower roller radii, and the first and second plunge depths are configured such that the first and second upper rollers and the first and second lower rollers are disposed to impart first and second bend radii on the metal plate as the metal plate is drawn through the serpentine path as the metal plate bends about the outer peripheral surfaces of the first and second upper rollers and the first and second lower rollers to provide equal plastification on both sides of the metal plate; and wherein the first and second bend radii are equivalent and are selected to achieve greater than 90% plastification on opposing sides of the metal plate that is fabricated from high-strength steel after the metal plate exits the leveling station; and wherein there is a quantity of not more than the first and second upper rollers and a quantity of not more than the first and second lower rollers to achieve equal plastification on both sides of the metal plate.

15. The device of claim 14, wherein the longitudinal spacing, the upper rolling radii, lower rolling radii, and the plunge depth are configured such that as the metal plate is drawn through the serpentine path in the longitudinal direction, the pair of upper rollers impart a first bending stress on a first side of the metal plate and the pair of lower rollers impart a second bending stress on a second side of the metal plate, opposite the first side, such that the first and second bending stresses are equal to provide equal plastification on the first and second sides of the metal plate.

* * * * *